US007786842B2

(12) United States Patent
Tsukada et al.

(10) Patent No.: US 7,786,842 B2
(45) Date of Patent: Aug. 31, 2010

(54) CHIP RESISTOR AND MANUFACTURING METHOD THEREOF

(75) Inventors: Torayuki Tsukada, Kyoto (JP); Masaki Yoneda, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 509 days.

(21) Appl. No.: 11/883,856

(22) PCT Filed: Feb. 28, 2006

(86) PCT No.: PCT/JP2006/303666

§ 371 (c)(1),
(2), (4) Date: Aug. 7, 2007

(87) PCT Pub. No.: WO2006/093107

PCT Pub. Date: Sep. 8, 2006

(65) Prior Publication Data

US 2008/0129443 A1 Jun. 5, 2008

(30) Foreign Application Priority Data

Mar. 2, 2005 (JP) ..... 2005-057692
Jun. 30, 2005 (JP) ..... 2005-192423

(51) Int. Cl.
*H01C 1/012* (2006.01)

(52) U.S. Cl. ..... 338/309; 338/332; 338/314

(58) Field of Classification Search ..... 338/307–309, 338/332, 328, 313–314, 322
See application file for complete search history.

(56) References Cited

U.S. PATENT DOCUMENTS 5,379,017 A * 1/1995 Katsuno ..... 338/332
5,917,403 A * 6/1999 Hashimoto et al. ..... 338/307
6,023,217 A * 2/2000 Yamada et al. ..... 338/309
6,242,999 B1 * 6/2001 Nakayama et al. ..... 338/309
6,492,896 B2 * 12/2002 Yoneda ..... 338/309
6,636,143 B1 * 10/2003 Hashimoto et al. ..... 338/309
7,098,768 B2 8/2006 Doi

FOREIGN PATENT DOCUMENTS

JP 8-236302 9/1996

(Continued)

OTHER PUBLICATIONS

International Search Report from the corresponding PCT/JP2006/303666, mailed May 23, 2006.

*Primary Examiner*—Kyung Lee
(74) *Attorney, Agent, or Firm*—Hamre, Schumann, Mueller & Larson, P.C.

(57) ABSTRACT

The chip resistor (1) includes an insulating substrate (2) and a main upper electrode (4) formed on a main surface of the insulating substrate (2). On the main surface of the insulating substrate (2), a resistor film (5) including an end (5*a*) overlapping the upper surface of main upper electrode (4) is formed. The resistor film (5) is covered by a protective coat (7, 8). An auxiliary upper electrode (6) is formed on the upper surface of the main upper electrode (4). The auxiliary upper electrode (6) includes an inner end (6*a*) overlapping the upper surface of the end (5*a*) of the resistor film (5). The protective coat (7, 8) overlaps the inner end (6*a*) of the auxiliary upper electrode (6).

7 Claims, 12 Drawing Sheets

FOREIGN PATENT DOCUMENTS

| | | |
|---|---|---|
| JP | 8-316002 | 11/1996 |
| JP | 9-205003 | 8/1997 |
| JP | 10-275706 | 10/1998 |
| JP | 2000-138102 | 5/2000 |
| JP | 2000-173802 | 6/2000 |
| JP | 2002-184602 | 6/2002 |
| WO | WO 03/046934 | 6/2003 |

* cited by examiner

CHIP RESISTOR AND MANUFACTURING METHOD THEREOF

TECHNICAL FIELD

The present invention relates to a chip resistor and a method for manufacturing a chip resistor. Specifically, the chip resistor according to the present invention includes an insulating substrate in the form of a chip and at least one resistor film formed on the substrate. External connection terminals are connected to each end of the resistor film. The resistor film is covered by a protective coat.

BACKGROUND ART

Conventionally, in this kind of chip resistor, the upper surface of the protective coat is not flat but projects largely at the center portion. Therefore, in moving the chip resistor using a collet of a vacuum suction type, the collet sometimes does not adhere firmly to the protective coat or the protective coat sometimes cracks.

In addition to the above, the conventional structure has the following drawback. Each of the external connection terminals of the conventional chip resistor includes a portion extending on the upper surface of the insulating substrate (hereinafter this portion is referred to as "upper electrode"). The upper electrode is held in contact with the resistor film. The upper electrode is made of conductive paste mainly composed of silver, and the thickness is made relatively small to facilitate the formation of the resistor film. With this structure, however, the upper electrode may be corroded by air, and in a serious case, the upper electrode is broken. This is because silver, which is the main component of the upper electrode, reacts with sulfur gas (such as hydrogen sulfide) in the atmosphere to become silver sulfide.

Patent Documents 1 and 2 described below propose techniques for coping with the above-described drawbacks. According to these documents, a relatively thick auxiliary upper electrode is formed on each of the upper electrodes (hereinafter referred to as "main upper electrode") connected to the resistor film. With this structure, the stepped portion between the center and the opposite ends of the upper surface of the substrate can be eliminated or reduced. Further, since the main upper electrode is covered by the auxiliary upper electrode, corrosion of the main upper electrode is expected to be reduced.

Patent Document 1: JP-A-H08-236302

Patent Document 2: JP-A-2002-184602

However, it has been found that, even with the above-described conventional structures, it is difficult to reliably prevent corrosion of the main upper electrode. Specifically, according to Patent Document 1, the auxiliary upper electrode is made of silver-based conductive paste. With this structure, corrosion due to e.g. sulfur components in the atmosphere may occur at the boundary between the auxiliary upper electrode and the protective coat, and the corrosion progresses to the main upper electrode positioned below.

According to Patent Document 2, the auxiliary upper electrode is made of nickel-based conductive paste. With this structure, damages such as cracking may occur at the boundary between the auxiliary upper electrode and the protective coat. Through the damaged portion, sulfur components in the atmosphere reach the main upper electrode to corrode the main upper electrode.

DISCLOSURE OF THE INVENTION

The present invention is proposed under the above-described circumstances. It is, therefore, an object of the present invention to provide a technique capable of solving or alleviating the above-described problems.

According to a first aspect of the present invention, there is provided a chip resistor comprising: an insulating substrate including a main surface; a main upper electrode formed on the main surface of the insulating substrate; a resistor film including a main resistor portion and an end connected to the main resistor portion, the main resistor portion being formed on the main surface of the insulating substrate, the end overlapping an upper surface of the main upper electrode; a protective coat covering the resistor film; and an auxiliary upper electrode formed on the main upper electrode. The auxiliary upper electrode includes an inner end overlapping an upper surface of the end of the resistor film. The protective coat overlaps the inner end of the auxiliary upper electrode.

Preferably, the main upper electrode is made of silver-based conductive paste, whereas the auxiliary upper electrode is made of silver-based conductive paste containing Pd.

Preferably, the chip resistor further comprises a side electrode formed on an end surface of the insulating substrate which is perpendicular to the main surface, the side electrode being connected to the main upper electrode.

According to a second aspect of the present invention, there is provided a method for manufacturing a chip resistor. The method comprises the steps of: forming a main upper electrode on an upper surface of an insulating substrate; forming a resistor film on the upper surface of the insulating substrate so that the resistor film includes an end directly overlapping an upper surface of the main upper electrode; forming an auxiliary upper electrode on the main upper electrode so that an inner end of the auxiliary upper electrode directly overlaps an upper surface of the end of the resistor film; forming a protective coat on the resistor film so that an end of the protective coat overlaps the inner end of the auxiliary upper electrode; and forming a side electrode on an end surface of the insulating substrate to be electrically connected to the auxiliary upper electrode.

Preferably, the main upper electrode, the resistor film and the auxiliary upper electrode are formed by baking applied material paste. The baking for forming the main upper electrode, the resistor film and the auxiliary upper electrode may be performed simultaneously.

According to a third aspect of the present invention, there is provided a chip resistor comprising: an insulating substrate including a main surface and two end surfaces spaced from each other in a longitudinal direction of the main surface; a main upper electrode formed on the main surface of the insulating substrate; a resistor film including a main resistor portion and an end, the main resistor portion being held in contact with the main surface of the insulating substrate, the end overlapping an upper surface of the main upper electrode; an auxiliary upper electrode which is formed on the main upper electrode and longer than the main upper-electrode in a width direction which is perpendicular to the longitudinal direction; an undercoat including a main portion covering the resistor film and an extension connected to the main portion, the extension extending on the auxiliary upper electrode and being shorter than the auxiliary upper electrode and longer than the main upper electrode in the width direction; an overcoat formed on the main portion of the undercoat; and an additional electrode formed on an upper surface of the extension of the undercoat, the additional electrode being longer than the extension in the width direction to partially come into contact with the auxiliary upper electrode, part of the additional electrode overlapping an upper surface of an end of the overcoat.

Preferably, the chip resistor further comprises a side electrode formed on an end surface of the insulating substrate and partially overlapping an upper surface of the additional electrode. Preferably, the chip resistor further comprises a metal plating layer formed on the additional electrode and the side electrode.

Preferably, the additional electrode is made of a silver-based conductive paste containing Pd, or a base metal conductive paste.

According to a fourth aspect of the present invention, there is provided a method for manufacturing a chip resistor. The method comprising the steps of: forming, on an upper surface of an insulating substrate, a main upper electrode and a resistor film partially overlapping an upper surface of the main upper electrode; forming, on the upper surface of the main upper electrode, an auxiliary upper electrode having a width larger than a width of the main upper electrode; forming an undercoat including a main portion and an extension connected to the main portion so that the main portion covers the resistor film and the extension overlaps an upper surface of the auxiliary upper electrode, the undercoat having a width larger than the width of the main upper electrode and smaller than the width of the auxiliary upper electrode; forming an overcoat on an upper surface of the main portion of the undercoat; and forming, on an upper surface of the extension of the undercoat, an additional electrode having a width larger than a width of the extension and partially overlapping an upper surface of the overcoat.

Preferably, the manufacturing method further comprises the steps of forming a side electrode on an end surface of the insulating substrate so that part of the side electrode overlaps part of an upper surface of the additional electrode, and forming a metal plating layer on the additional electrode and the side electrode.

Other features and advantages of the present invention will become more apparent from the detailed description given below with reference to the accompanying drawings.

BEST MODE FOR CARRYING OUT THE INVENTION

Preferred embodiments of the present invention will be described below with reference to the accompanying drawings.

Figure 1:
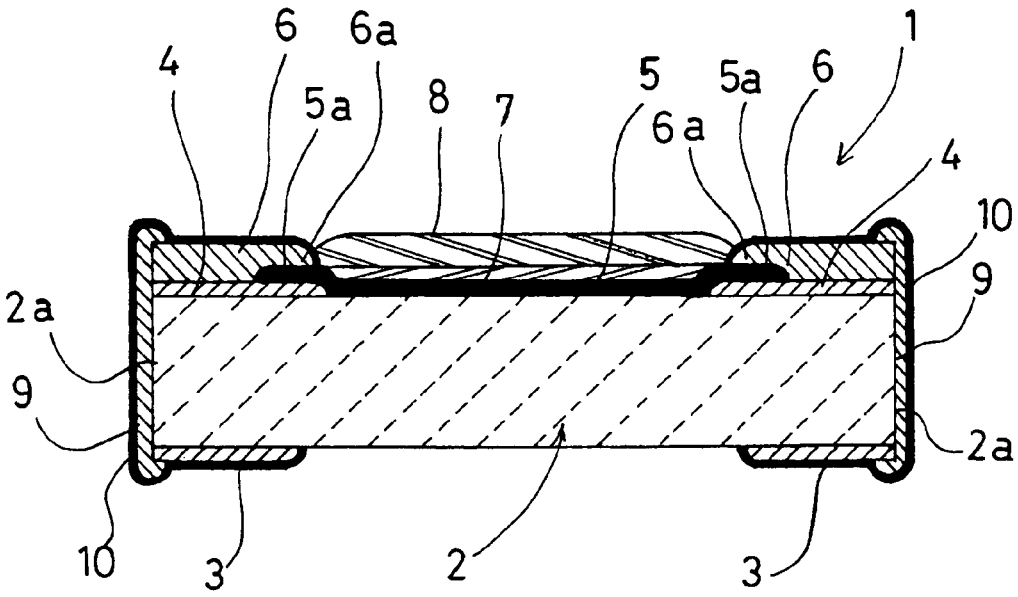
FIG. 1 is a sectional view showing a chip resistor according to a first embodiment of the present invention.

FIG. 1 shows a chip resistor 1 according to a first embodiment of the present invention. The chip resistor 1 includes an insulating substrate 2, which includes an upper surface (main surface), a lower surface which is opposite from the upper surface, and two end surfaces 2*a* spaced from each other via the upper surface (and the lower surface).

The lower surface of the insulating substrate 2 is formed with a pair of lower electrodes 3. The lower electrodes 3 are provided at each end (right end and left end in the figure) of the insulating substrate 2 to be spaced from each other. The upper surface of the insulating substrate 2 is formed with a pair of main upper electrodes 4. The main upper electrodes 4 are also provided at opposite ends of the insulating substrate 2 to be spaced from each other.

The upper surface of the insulating substrate 2 is further formed with a resistor film 5 provided between the two main upper electrodes 4. Specifically, the resistor film 5 includes a main resistor portion (the portion which substantially functions as a resistor) and two ends 5*a* spaced from each other via the main resistor portion. As shown in FIG. 1, the main resistor portion is in direct contact with the upper surface of the insulating substrate 2, whereas each of the ends 5*a* is piled up on a corresponding one of the main upper electrodes 4. In this way, the resistor film 5 partially overlaps the main upper electrodes 4.

An auxiliary upper electrode 6 is formed on each of the main upper electrodes 4. As will be understood from FIG. 1, the thickness of the auxiliary upper electrodes 6 is larger than that of the main upper electrodes 4. The inner end 6*a* of each of the auxiliary upper electrode 6 directly overlaps the end 5*a* of the resistor film 5. As a result, as viewed in the vertical direction of FIG. 1, the end 5*a* of the resistor film 5 is sandwiched between the main upper electrode 4 and the auxiliary upper electrode 6.

A protective coat for covering the resistor film 5 is formed between the two auxiliary upper electrodes 6. The protective coat has a two-layer structure comprising an undercoat 7 directly covering the main resistor portion of the resistor film 5 and an overcoat 8 formed on the undercoat 7. The undercoat 7 and the overcoat 8 may be made of glass. Each end of the protective coat (more precisely, each end of the overcoat 8) is held in contact with or overlaps the inner end 6*a* of the auxiliary upper electrode 6.

In the chip resistor 1 shown in FIG. 1, by appropriately setting the thickness of the auxiliary upper electrode 6, a large stepped portion is prevented from being formed between the upper surface of the overcoat 8 and the upper surface of the auxiliary upper electrode 6. Instead of this structure, an additional electrode for thickness adjustment may be formed on the auxiliary upper electrode 6.

Each end surface 2*a* of the insulating substrate 2 is formed with a side electrode 9. Each of the side electrodes 9 is electrically connected to both of the corresponding lower electrode 3 and the corresponding auxiliary upper electrode 6. As shown in FIG. 1, the lower end of each of the side electrodes 9 partially overlaps the lower surface of the lower electrode 3, whereas the upper end of the side electrode 9 partially overlaps the upper surface of the auxiliary upper electrode 6. When the above-described additional electrode for thickness adjustment is used, the side electrode 9 is electrically connected also to the additional electrode in addition to the lower electrode 3 and the auxiliary upper electrode 6.

Metal plating layers 10 are formed on the lower electrodes 3, the auxiliary upper electrodes 6 and the side electrodes 9. Each of the metal plating layers 10 has a two-layer structure comprising a base layer and a solder layer formed on the base layer. The base layer covers the lower electrode 3, the auxiliary upper electrode 6 and the side surface 9 and may be formed by nickel plating. The solder layer may be made of tin or solder.

In the above-described structure, the end 5*a* of the resistor film 5 exists under the boundary between the auxiliary upper electrode 6 and the overcoat 8. Therefore, even when corrosion due to sulfur components in the atmosphere occurs at the boundary, the end 5*a* of the resistor film prevents the corrosion from progressing to the main upper electrode 4. Further, air is prevented from entering through the boundary toward the main upper electrode 4.

Moreover, with the above-described structure, the two auxiliary upper electrodes 6 are held in direct contact with the resistor film 5. This arrangement makes it possible to supply power to the resistor film 5 through both of the auxiliary upper electrodes 6 and the main upper electrodes 4. Therefore, the resistance (specific resistance) at the external connection terminal is considerably reduced.

In the present invention, the auxiliary upper electrodes 6 may be made of silver-based conductive paste containing Pd. With this arrangement, in addition to the reduction of the specific resistance at the auxiliary upper electrodes 6, corrosion of the auxiliary upper electrodes 6 is also advantageously reduced.

The chip resistor 1 can be manufactured by the following process.

Figure 2:
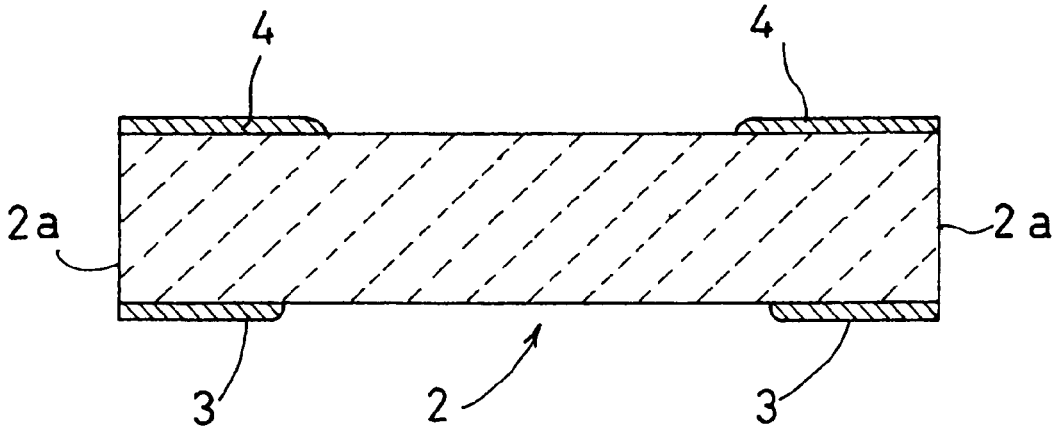
FIG. 2 is a sectional view for describing the first step of a method for manufacturing the chip resistor.

First, as shown in FIG. 2, a pair of lower electrodes 3 and a pair of main upper electrodes 4 are formed oh an insulating substrate 2 (first step). These electrodes can be formed by applying silver-based conductive paste by screen printing and then baking the applied paste at a high temperature. Specifically, the lower electrodes 3 may be formed first, and then the main upper electrodes 4 may be formed. Alternatively, the lower electrodes 3 and the main upper electrodes 4 may be formed simultaneously.

Figure 3:
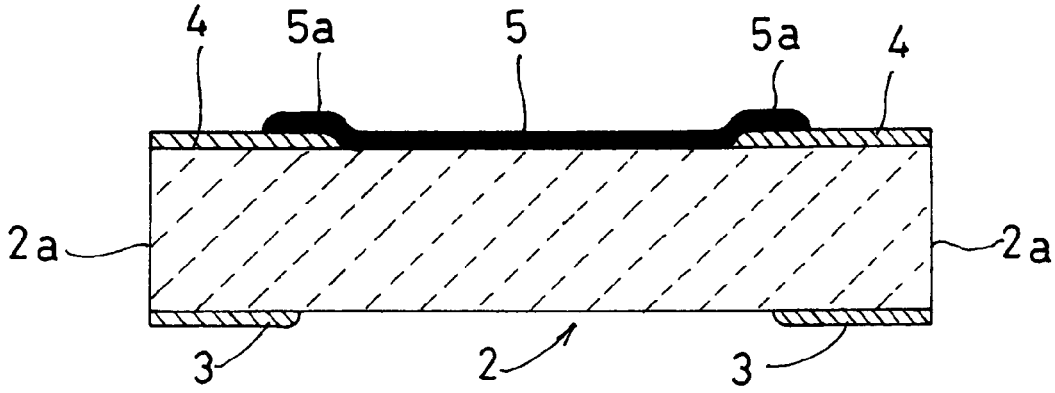
FIG. 3 is a sectional view for describing the second step of the manufacturing method.

Then, as shown in FIG. 3, a resistor film 5 is formed on the upper surface of the insulating substrate 2 (second step). The resistor film 5 can be formed by applying predetermined resistor material paste by screen printing and then baking the applied paste at a high temperature. As shown in the figure, the opposite ends 5*a* of the resistor film 5 partially overlap the upper surface of the main upper electrode 4.

Figure 4:
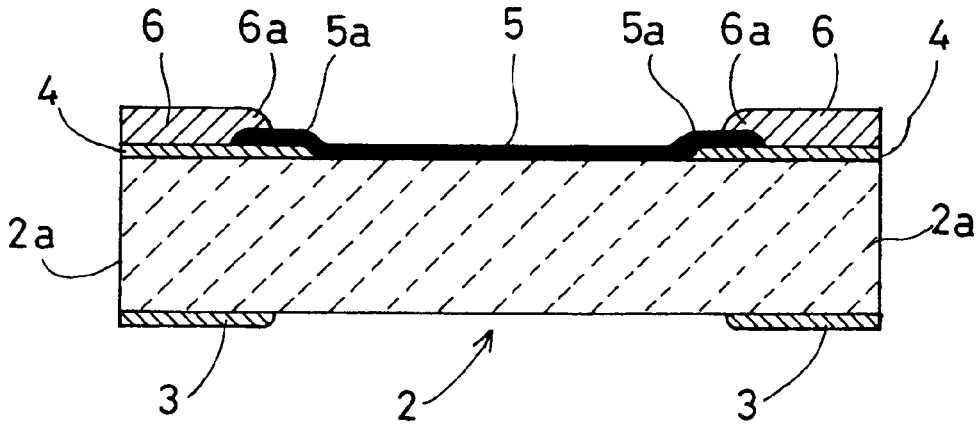
FIG. 4 is a sectional view for describing the third step of the manufacturing method.

Then, as shown in FIG. 4, an auxiliary upper electrode 6 is formed on each of the main upper electrodes 4 (third step). The auxiliary upper electrodes 6 can be formed by applying silver-based conductive paste (or Pd-containing silver-based conductive paste) by screen printing and then baking the applied paste at a high temperature. As shown in the figure, each of the auxiliary upper electrodes 6 is partially held in contact with the upper surface of the main upper electrode 4, and the inner end 6*a* thereof partially overlaps the upper surface of the resistor film 5.

In the above-described process, the baking of the material paste is performed in each of the first, the second and the third steps. The present invention, however, is not limited to this. For instance, after the application and baking of the paste to form the lower electrode 3 is performed, collective baking for simultaneously forming three kinds of parts, i.e., the main upper electrodes 4, the resistor film 5 and the auxiliary upper electrodes 6 may be performed.

Figure 5:
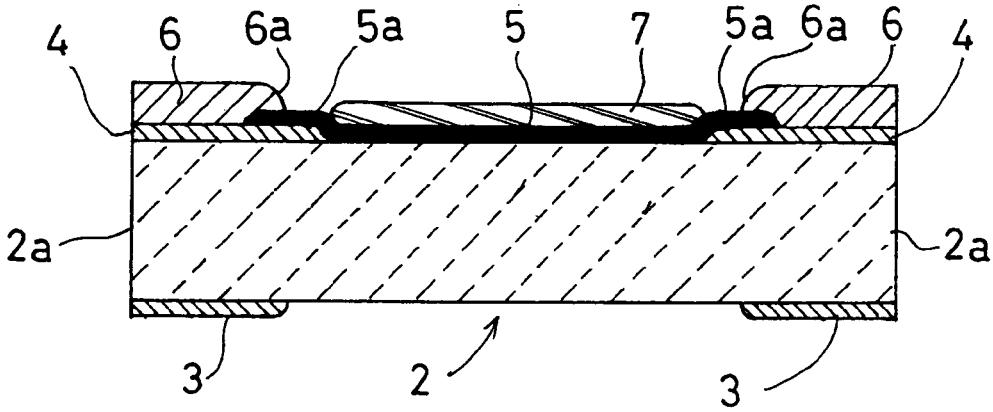
FIG. 5 is a sectional view for describing the fourth step of the manufacturing method.

Then, as shown in FIG. 5, an undercoat 7 for covering the main resistor portion (the portion between the opposite ends 5*a*) of the resistor film 5 is formed (fourth step). The undercoat 7 can be formed by applying glass paste by screen printing and then baking the applied paste at the softening temperature of the glass. After the undercoat 7 is formed, trimming of the resistor film 5 is performed to adjust the resistance to a predetermined value.

Figure 6:
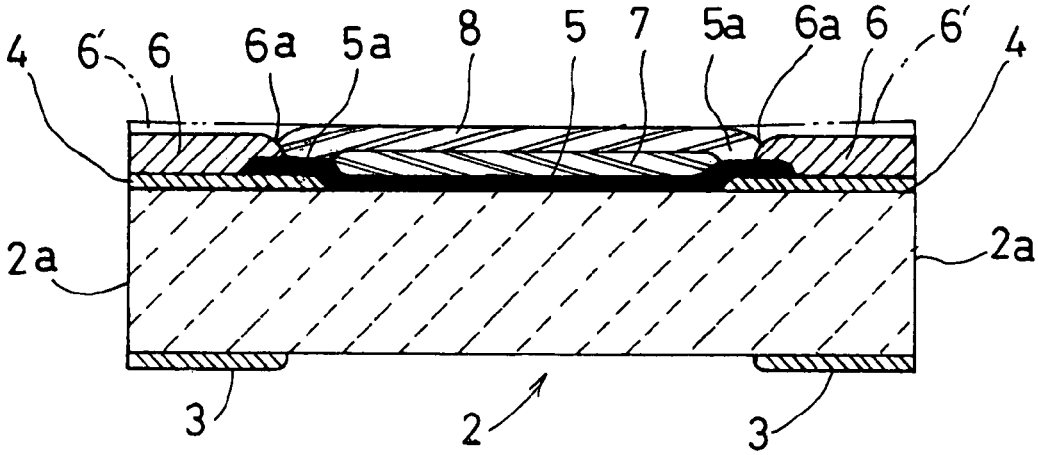
FIG. 6 is a sectional view for describing the fifth step of the manufacturing method.

Then, as shown in FIG. 6, an overcoat 8 for covering the undercoat 7 is formed (fifth step). The overcoat 8 can be formed by applying glass paste by screen printing and then baking the applied paste at the softening temperature of the glass. To form the overcoat 8, use may be made of the same kind of glass paste as that of the undercoat 7 or a different kind of glass paste.

In the fifth step, a large stepped portion may be formed between the upper surface of the overcoat 8 and the upper surface of the auxiliary upper electrode 6. In this case, an additional electrode 6' (See double-dashed lines in FIG. 6) for adjusting the stepped portion is formed on the upper surface of the auxiliary upper electrode 6.

Figure 7:
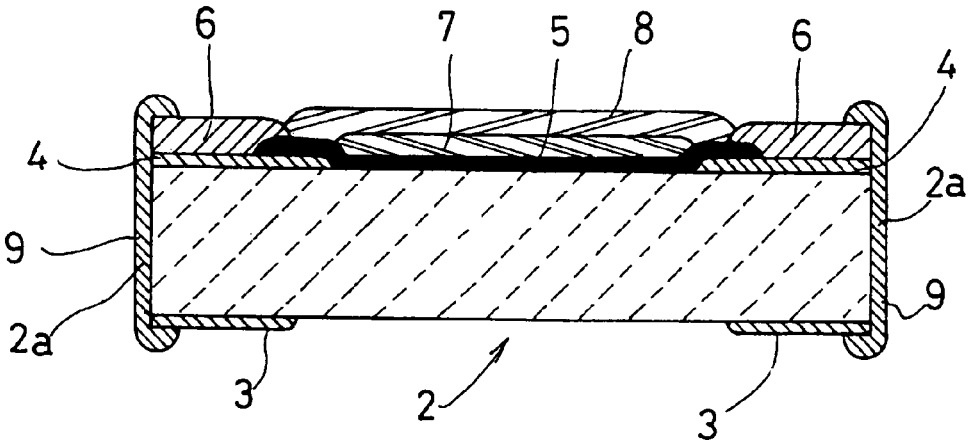
FIG. 7 is a sectional view for describing the sixth step of the manufacturing method.

Then, as shown in FIG. 7, a side electrode 9 is formed on each of the side surfaces 2*a* of the insulating substrate 2 (sixth step). The side electrode 9 can be formed by applying silver-based conductive paste and then baking the applied paste at a high temperature. The side electrode 9 is connected to the lower electrode 3 and the upper electrode 4, 6.

Finally, metal plating layers 10 (See FIG. 1) are formed on the lower electrodes 3, the auxiliary upper electrodes 6 (or additional electrodes 6') and the side electrodes 9. In this way, the chip resistor 1 shown in FIG. 1 is obtained. The metal plating layers 10 may be formed by barrel plating.

Figure 8:
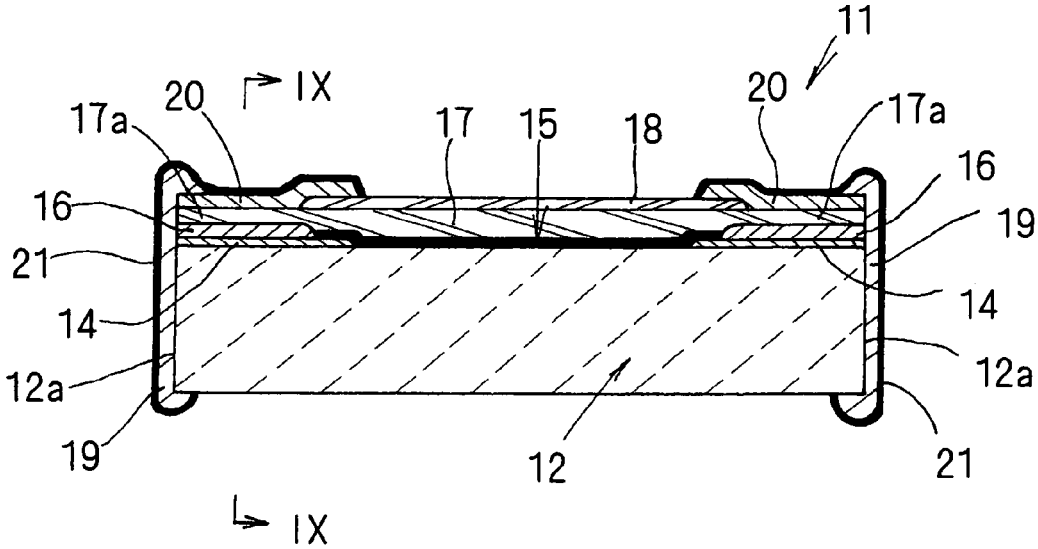
FIG. 8 is a sectional view showing a chip resistor according to a second embodiment of the present invention.
Figure 10:
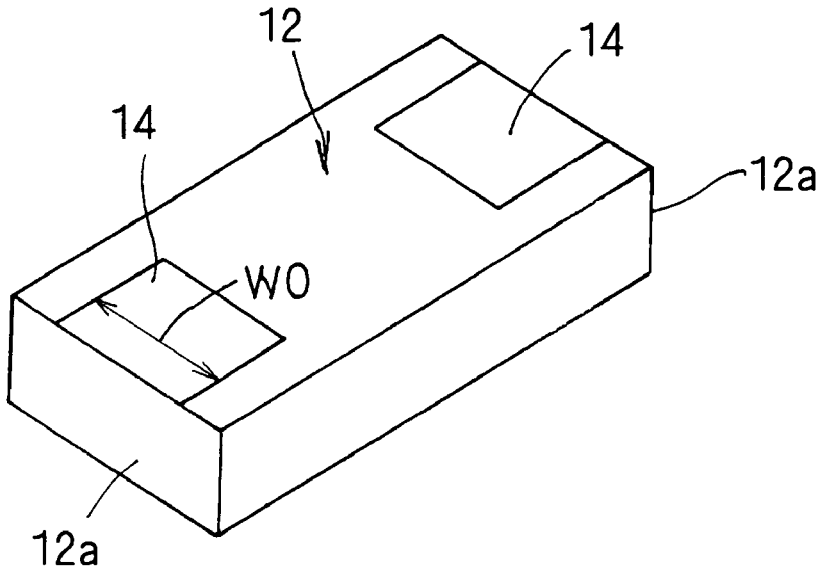
FIG. 10 is a perspective view for describing the first step of a method for manufacturing the chip resistor of FIG. 8.

FIG. 8 shows a chip resistor 11 according to a second embodiment of the present invention. Similarly to the above-described first embodiment, the chip resistor 11 includes an insulating substrate 12 in the form of a rectangular parallelepiped. The upper surface (main surface) of the insulating substrate 12 is formed with a pair of main upper electrodes 14 and a resistor film 15 connected to the electrodes. As shown in FIG. 10, the two main upper electrodes 14 are spaced from each other in the longitudinal direction of the insulating substrate 12. Each of the main upper electrodes 14 has a predetermined width W0. Herein, the "width" means the dimension in the horizontal direction ("width direction") which is perpendicular to the longitudinal direction of the insulating substrate 12 (or the upper surface thereof). The resistor film 15 includes a main resistor portion (the portion which substantially functions as a resistor) held in direct contact with the upper surface of the insulating substrate 12, and two ends spaced from each other via the main resistor portion. Each of the ends overlaps the upper surface of the corresponding main upper electrode 14.

On each of the main upper electrodes 14, a first auxiliary upper electrode 16 is formed to be laminated. Each of the first auxiliary upper electrodes 16 has a predetermined width W1 (See FIG. 13). As will be understood from FIG. 9, the width W1 of the first auxiliary upper electrode 16 is larger than the width W0 of the main upper electrodes 14. In the illustrated example, the width W1 is equal to the width of the insulating substrate 12.

Figure 9:
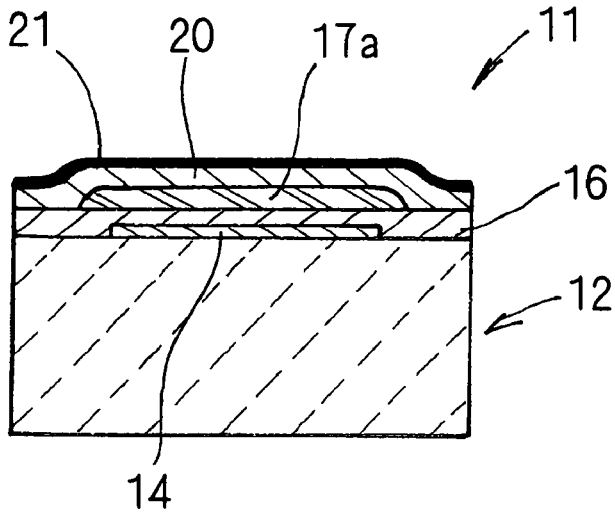
FIG. 9 is a sectional view taken along lines IX-IX in FIG. 8.

A protective coat for covering the resistor film 15 is formed on the resistor film. The protective coat has a two-layer structure comprising an undercoat 17 and an overcoat 18. The undercoat 17 directly covers the resistor film 15. The opposite ends 17*a* (hereinafter referred to as "extensions 17*a*") of the undercoat 17 are held in contact with the first auxiliary upper electrodes 16 and extend up to the end surfaces 12*a* of the insulating substrate 12. As shown in FIG. 9, the width W2 (See FIG. 16) of the extensions 17*a* is set to a value which is intermediate between the width W0 of the main upper electrode 14 and the width W1 of the first auxiliary upper electrode 16. (That is, the relationship W0<W2<W1 is established.) Therefore, the upper surface of each of the first auxiliary upper electrodes 16 includes two uncovered portions 16*a* (See FIG. 16) which are not covered by the extension 17*a*.

As shown in FIG. 8, the overcoat 18 is formed on the undercoat 17. However, as viewed in the longitudinal direction of the substrate 12, the overcoat 18 is shorter than the undercoat 17 and does not cover the opposite extensions 17*a* of the undercoat 17.

On each of the extensions 17*a* of the undercoat 17, a second auxiliary upper electrode ("additional electrode") 20 for covering the extension 17*a* is formed. The second auxiliary upper electrode 20 has a predetermined width W3 (See FIG. 21). The width W3 is larger than the width W2 of the extension 17*a* of the undercoat 17 (W2<W3). Therefore, each of the second auxiliary upper electrodes 20 directly overlaps the uncovered portions 16*a* of the first auxiliary upper electrode 16 (See FIG. 9). As shown in FIG. 8, each of the second auxiliary upper electrodes 20 includes an inner end partially overlapping the upper surface of the overcoat 18.

Each of the opposite end surfaces 12*a* of the insulating substrate 12 is formed with a side electrode 19. Each of the side electrodes 19 partially overlaps the upper surface of the corresponding second auxiliary upper electrode 20. Further, the side electrode 19 partially overlaps the lower surface of the insulating substrate 12.

Metal plating layers 21 are formed on the second auxiliary upper electrodes 20 and the side electrodes 19. Each of the metal plating layers 21 has a two-layer structure comprising a base layer and a solder layer formed on the base layer. The base layer may be made by nickel plating. The solder layer may be made by plating using tin or solder.

With the above-described structure, the side electrode 19 and the metal plating layer 21 are reliably connected electrically to the main upper electrode 14 via the second auxiliary upper electrode 20 and the first auxiliary upper electrode 16. Further, the stepped portion between the upper surface of the overcoat 18 and the upper surface of the second auxiliary upper electrode 20 is advantageously made small or eliminated by the lamination of the first auxiliary upper electrode 16, the extension 17*a* of the undercoat 17 and the second auxiliary upper electrode 20.

Each of the main upper electrodes 14 is covered by three parts, i.e., the first and the second auxiliary upper electrodes 16, 20 and the extension 17*a* of the undercoat 17 provided between the auxiliary upper electrodes. Therefore, even when the portion of the second auxiliary upper electrode 20 which overlaps the overcoat 18 is removed or broken, the first auxiliary upper electrode 16 and the extension 17*a* of the undercoat 17 reliably prevent air from reaching the main upper electrode 14.

The chip resistor 11 according to the second embodiment can be manufactured by the following process.

First, as shown in FIG. 10, a pair of main upper electrodes 14 (width W0) are formed on the upper surface of an insulating substrate 12 (first step). The main upper electrodes 14 can be formed by applying silver-based conductive paste by screen printing and then baking the applied paste.

Figure 11:
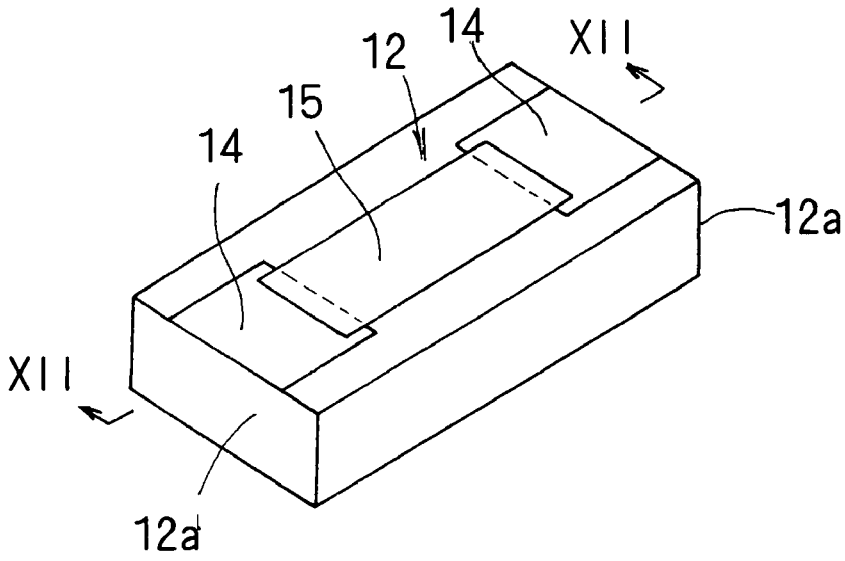
FIG. 11 is a perspective view for describing the second step of the method for manufacturing the chip resistor of FIG. 8.
Figure 12:
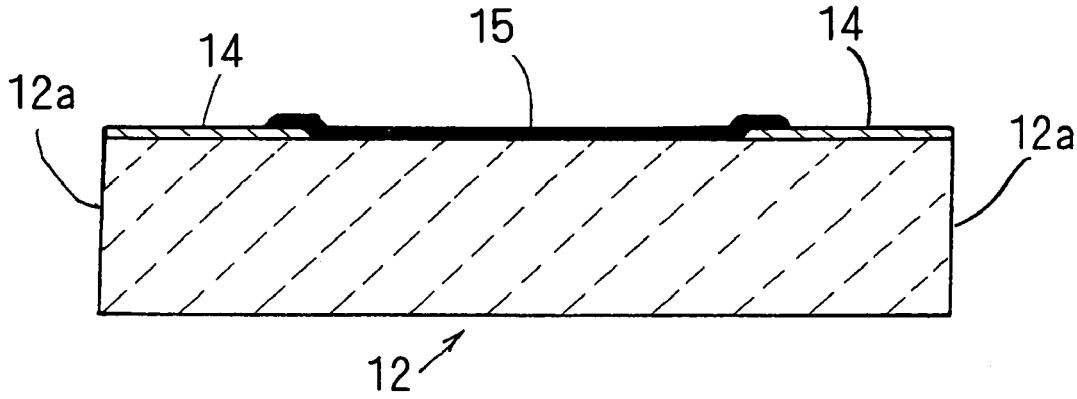
FIG. 12 is a sectional view taken along lines XII-XII in FIG. 11.

Then, as shown in FIGS. 11 and 12, a resistor film 15 is formed between the two main upper electrodes 14 on the upper surface of the insulating substrate 12 (second step). The opposite ends of the resistor film 15 are electrically connected to the main upper electrodes 14, respectively. The resistor film 15 can be formed by the application of resistor material paste by screen printing and the subsequent baking.

In the present invention, the resistor film 15 may be formed first, and then the paired main upper electrodes 14 may be formed. In this case, each of the main upper electrodes 14 partially lies on the resistor film 15. Further, a pair of lower electrodes may be formed on the lower surface of the insulating substrate 12. In this case, the above-described first step is performed after the lower electrodes are formed.

After the resistor film 15 is formed, a glass coat (not shown) for covering only the resistor film 15 is formed. Thereafter, trimming is performed to adjust the resistance of the resistor film 15 to a predetermined value.

Figure 13:
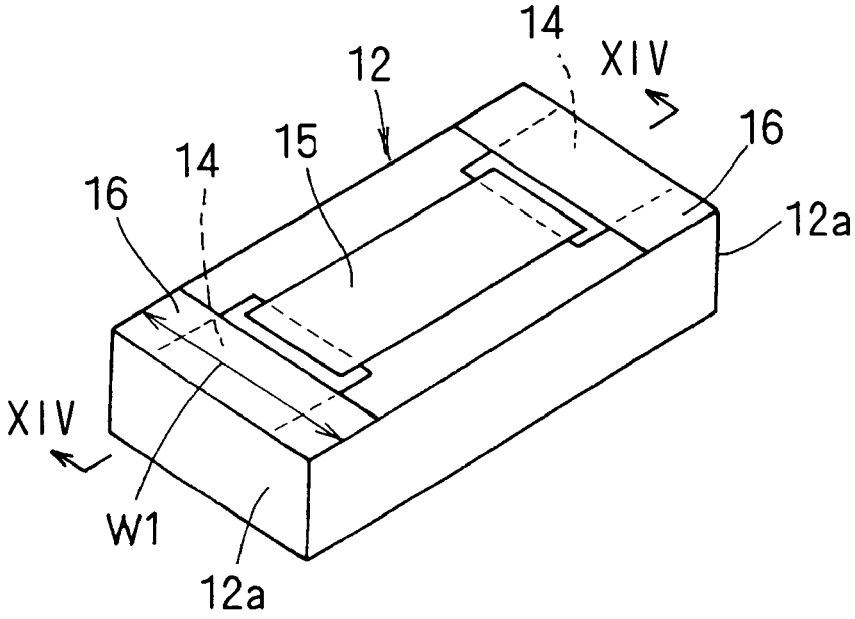
FIG. 13 is a perspective view for describing the third step of the method for manufacturing the chip resistor of FIG. 8.
Figure 14:
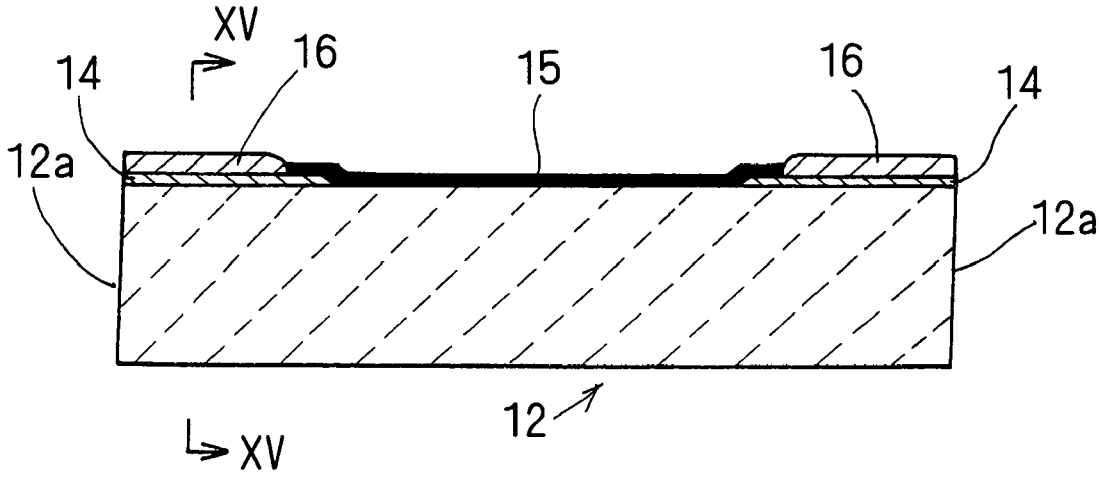
FIG. 14 is a sectional view taken along lines XIV-XIV in FIG. 13.
Figure 15:
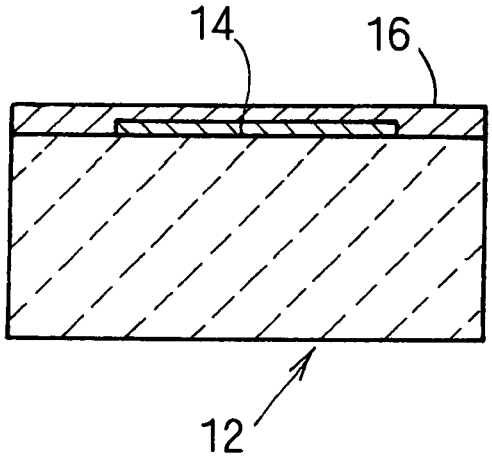
FIG. 15 is a sectional view taken along lines XV-XV in FIG. 14.

Then, as shown in FIGS. 13-15, a first auxiliary upper electrode 16 is formed on each of the main upper electrodes 14 (third step). The first auxiliary upper electrode 16 can be formed by applying conductive paste by screen printing and then baking the applied paste. In forming the first auxiliary upper electrode, the width W1 of the first auxiliary upper electrode 16 is made larger than the width W0 of the main upper electrode 14. As a result, as viewed in the transverse direction of the substrate 12 (See FIG. 15), the first auxiliary upper electrode 16 covers the entirety of the main upper electrode 14.

The first auxiliary upper electrode 16 may be formed using a conductive paste mainly composed of silver. Alternatively, the first auxiliary upper electrode 16 may be formed using a silver-based conductive paste containing Pd, or a conductive paste which is mainly composed of a base metal such as nickel and does not contain silver (hereinafter referred to as "base metal conductive paste"). When the silver-based conductive paste or the Pd-containing silver-based conductive paste is used, the resistance (specific resistance) of the first auxiliary upper electrode 16 is advantageously reduced. When the Pd-containing silver-based conductive paste or the base metal conductive paste is used, it is possible to prevent corrosion of the first auxiliary upper electrode 16, thereby enhancing the corrosion resistance of the main upper electrodes 14 made of silver-based conductive paste.

Figure 16:
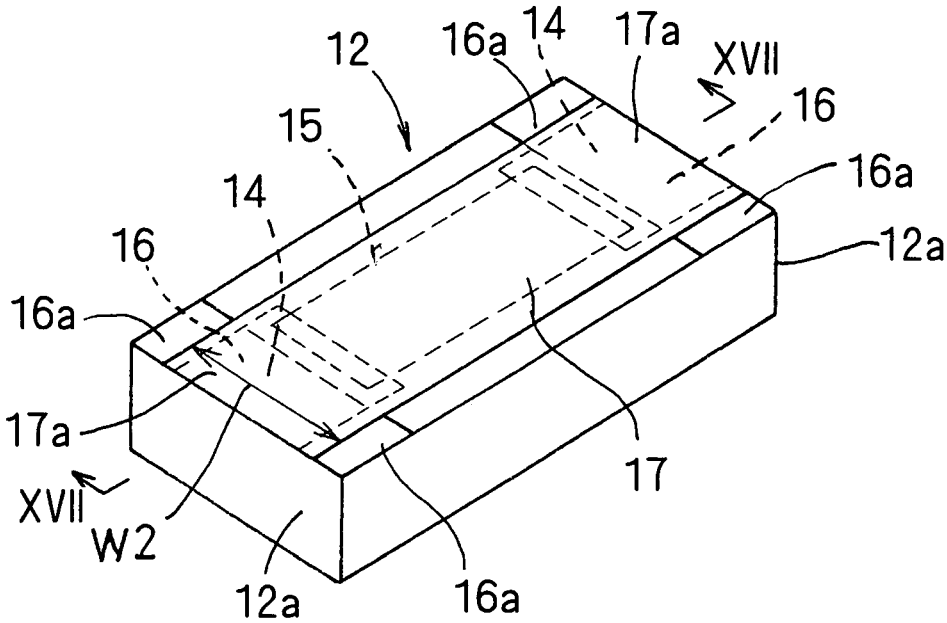
FIG. 16 is a perspective view for describing the fourth step of the method for manufacturing the chip resistor of FIG. 8.
Figure 17:
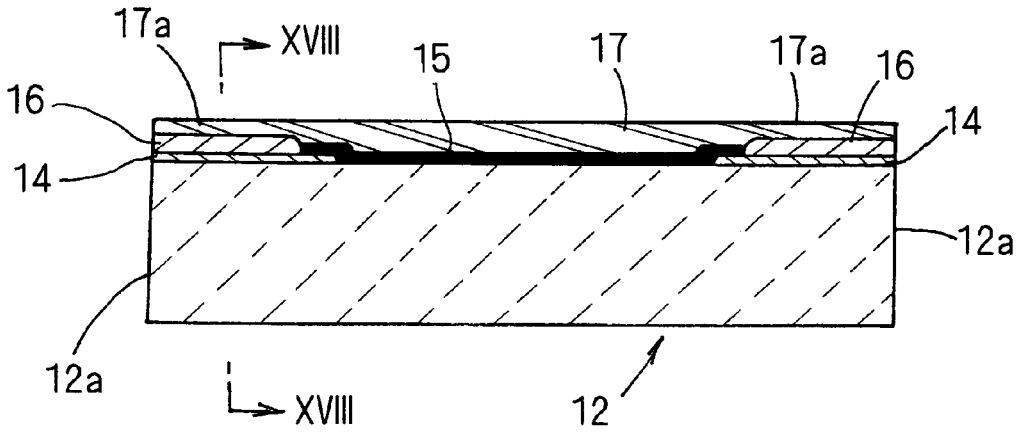
FIG. 17 is a sectional view taken along lines XVII-XVII in FIG. 16.
Figure 18:
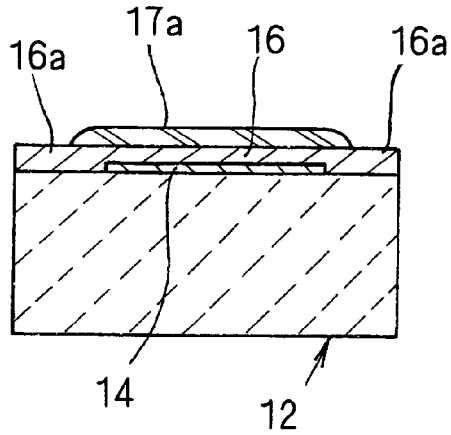
FIG. 18 is a sectional view taken along lines XVIII-XVIII in FIG. 17.

Then, as shown in FIGS. 16-18, an undercoat 17 for covering the resistor film 15 is formed on the resistor film (fourth step). The undercoat 17 can be formed by the application of glass paste by screen printing and the subsequent baking. The undercoat 17 integrally includes extensions 17*a* covering the first auxiliary upper electrodes 16 and extending up to the opposite end surfaces 12*a* of the insulating substrate 12.

As noted before, the width W2 of the extensions 17*a* of the undercoat 17 is set to a value which is intermediate between the width W0 of the main upper electrode 14 and the width W1 of the first auxiliary upper electrode 16. Therefore, the first auxiliary upper electrode 16 includes uncovered portions 16*a* which are not covered by the extension 17*a*.

Figure 19:
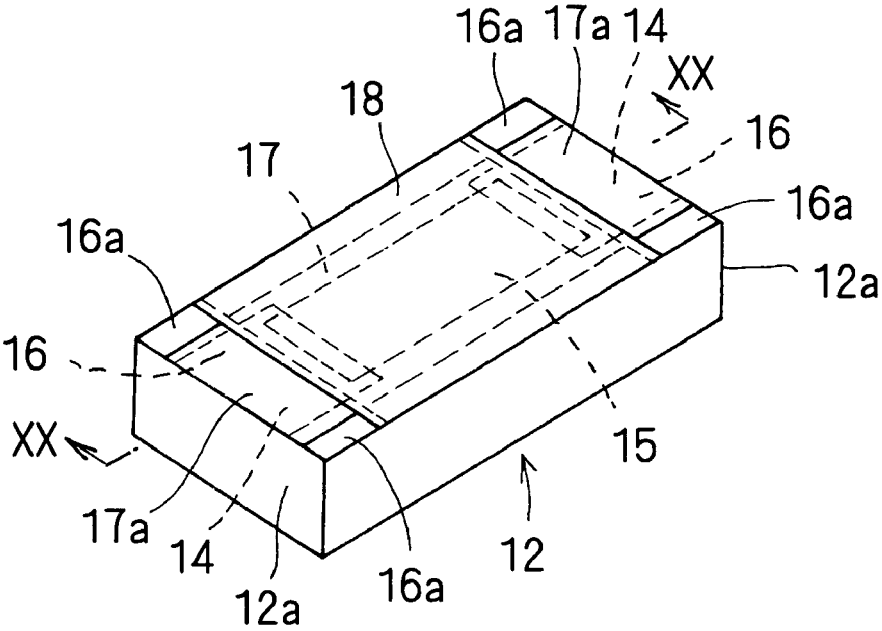
FIG. 19 is a perspective view for describing the fifth step of the method for manufacturing the chip resistor of FIG. 8.
Figure 20:
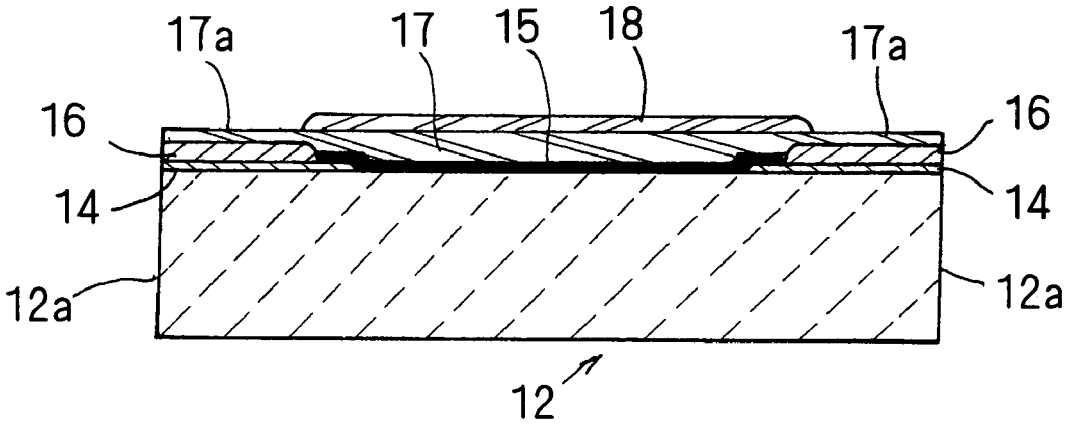
FIG. 20 is a sectional view taken along lines XX-XX in FIG. 19.

Then, as shown in FIGS. 19 and 20, an overcoat 18 is formed on a region of the upper surface of the undercoat 17 except the extensions 17*a* (fifth step). The overcoat 18 can be formed by the application of glass paste by screen printing and the subsequent baking of the applied paste. Alternatively, the overcoat can be formed by applying synthetic resin in a liquid state by screen printing and then hardening the resin.

Figure 21:
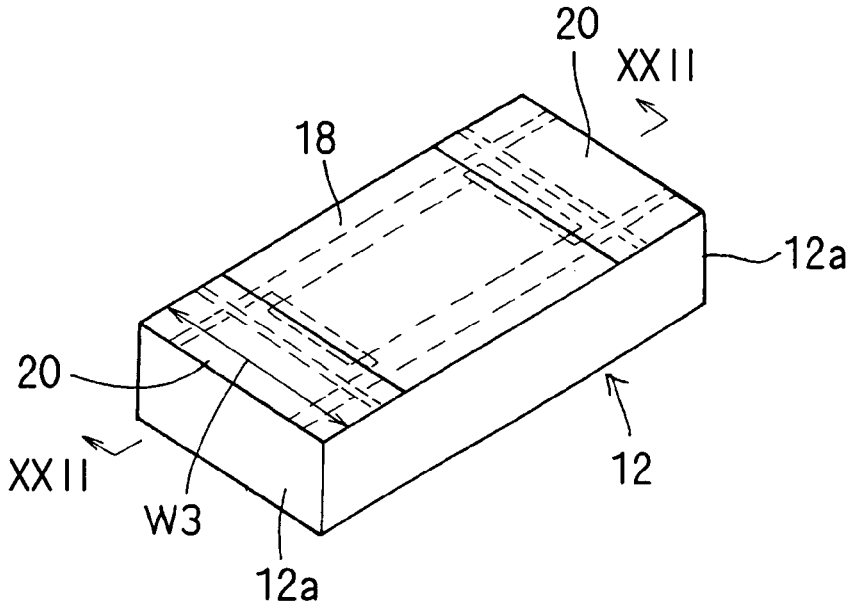
FIG. 21 is a perspective view for describing the sixth step of the method for manufacturing the chip resistor of FIG. 8.
Figure 22:
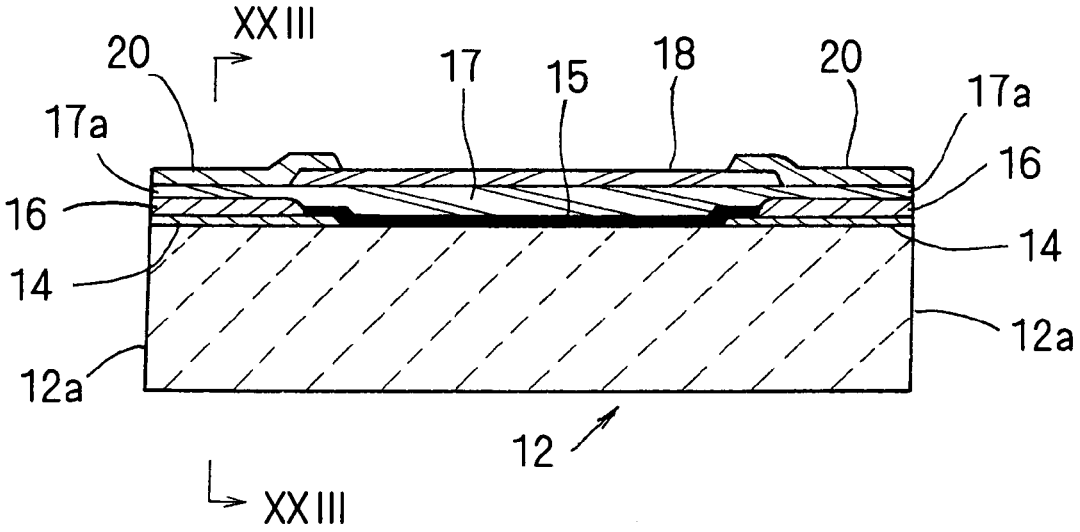
FIG. 22 is a sectional view taken along lines XXII-XXII in FIG. 21.
Figure 23:
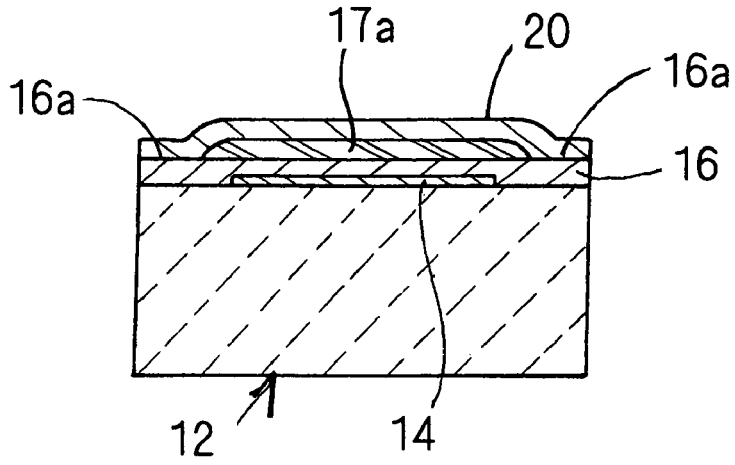
FIG. 23 is a sectional view taken along lines XXIII-XXIII in FIG. 22.

Then, as shown in FIGS. 21-23, second auxiliary upper electrodes 20 for covering the opposite extensions 17*a* of the undercoat 17 are formed on the extensions 17*a* (sixth step). The width W3 of the second auxiliary upper electrodes 20 is set to be larger than the width W2 of the extensions 17*a* of the undercoat 17. As a result, as shown in FIG. 23, each of the second auxiliary upper electrodes 20 overlaps, at the opposite ends thereof, the uncovered portions 16*a* of the first auxiliary upper electrode 16. Further, as shown in FIG. 22, part of the second auxiliary upper electrode 20 overlaps an end of the overcoat 18. The second auxiliary upper electrode 20 can be formed using similar kind of conductive paste to that of the first auxiliary upper electrode 16.

Figure 24:
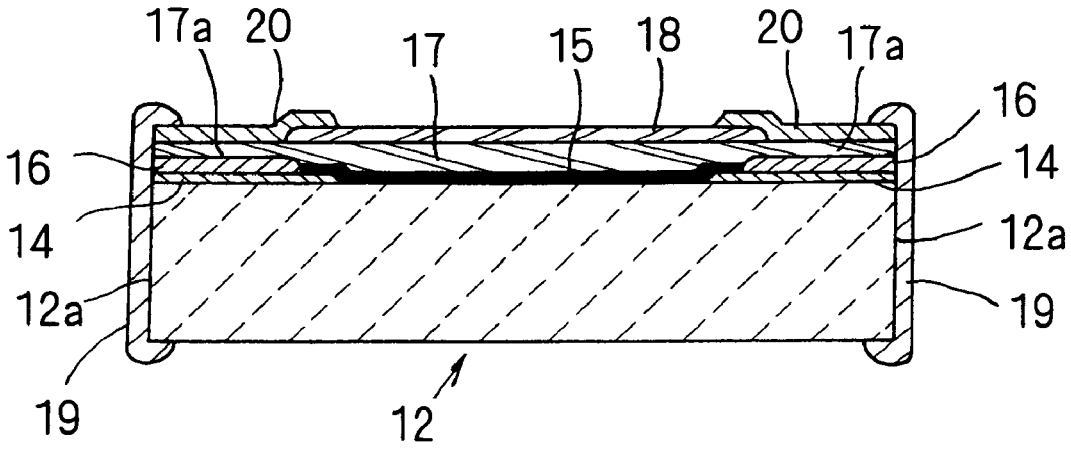
FIG. 24 is a sectional view for describing the seventh step of the method for manufacturing the chip resistor of FIG. 8.

Then, as shown in FIG. 24, a side electrode 19 is formed on each of the end surfaces 12*a* of the insulating substrate 12 (seventh step). The side electrode 19 is formed to overlap part of the upper surface of the second auxiliary upper electrode 20 and part of the lower surface of the insulating substrate 12. When a lower electrode is formed on the lower surface of the insulating substrate 12, the side electrode 19 overlaps part of the lower electrode.

Then, by performing barrel plating, metal plating layers 21 (See FIG. 8) are formed on the side electrodes 19 and the second auxiliary upper electrodes 20 (eighth step). In this way, the chip resistor 11 according to the second embodiment is obtained. When a lower electrode is formed on the lower surface of the insulating substrate 12, the metal plating layer 21 is formed also on the lower electrode.

The invention claimed is:

1. A chip resistor comprising:

an insulating substrate including a main surface and two end surfaces spaced from each other in a longitudinal direction of the main surface;

a main upper electrode formed on the main surface of the insulating substrate;

a resistor film including a main resistor portion and an end, the main resistor portion being held in contact with the main surface of the insulating substrate, the end overlapping an upper surface of the main upper electrode;

an auxiliary upper electrode which is formed on the main upper electrode and longer than the main upper electrode in a width direction which is perpendicular to the longitudinal direction;

an undercoat including a main portion covering the resistor film and an extension connected to the main portion, the extension extending on the auxiliary upper electrode and being shorter than the auxiliary upper electrode and longer than the main upper electrode in the width direction;

an overcoat formed on the main portion of the undercoat; and an additional electrode formed on an upper surface of the extension of the undercoat, the additional electrode being longer than the extension in the width direction to partially come into contact with the auxiliary upper electrode, part of the additional electrode overlapping an upper surface of an end of the overcoat.

2. The chip resistor according to claim 1, further comprising a side electrode formed on an end surface of the insulating substrate and partially overlapping an upper surface of the additional electrode.

3. The chip resistor according to claim 2, further comprising a metal plating layer formed on the additional electrode and the side electrode.

4. The chip resistor according to claim 1, wherein the additional electrode is made of silver-based conductive paste containing Pd.

5. The chip resistor according to claim 1, wherein the additional electrode is made of a base metal conductive paste.

6. A method for manufacturing a chip resistor, the method comprising the steps of:

forming, on an upper surface of an insulating substrate, a main upper electrode and a resistor film partially overlapping an upper surface of the main upper electrode;

forming, on the upper surface of the main upper electrode, an auxiliary upper electrode having a width larger than a width of the main upper electrode;

forming an undercoat including a main portion and an extension connected to the main portion so that the main portion covers the resistor film and the extension overlaps an upper surface of the auxiliary upper electrode, the undercoat having a width larger than the width of the main upper electrode and smaller than the width of the auxiliary upper electrode;

forming an overcoat on an upper surface of the main portion of the undercoat; and forming, on an upper surface of the extension of the undercoat, an additional electrode having a width larger than a width of the extension and partially overlapping an upper surface of the overcoat.

7. The manufacturing method according to claim 6, further comprising the steps of forming a side electrode on an end surface of the insulating substrate so that part of the side electrode overlaps part of an upper surface of the additional electrode, and forming a metal plating layer on the additional electrode and the side electrode.

* * * * *